US007294051B2

(12) United States Patent
Bell

(10) Patent No.: US 7,294,051 B2
(45) Date of Patent: Nov. 13, 2007

(54) COIN HOPPER WITH LARGE COIN CAPABILITY

(75) Inventor: Malcolm Reginald Hallas Bell, Westwood Leeds (GB)

(73) Assignee: Money Controls Limited, Oldham (GB)

( * ) Notice: Subject to any disclaimer, the term of this patent is extended or adjusted under 35 U.S.C. 154(b) by 0 days.

(21) Appl. No.: 11/157,676

(22) Filed: Jun. 21, 2005

(65) Prior Publication Data

US 2006/0011418 A1 Jan. 19, 2006

(30) Foreign Application Priority Data

Jun. 29, 2004 (GB) ..... 0414557.9

(51) Int. Cl.
*G07D 1/00* (2006.01)

(52) U.S. Cl. ..... 453/49; 453/18; 453/39

(58) Field of Classification Search ..... 453/18, 453/20, 33, 39, 49, 50, 51, 52, 57
See application file for complete search history.

(56) References Cited

U.S. PATENT DOCUMENTS

| | | | | |
|---|---|---|---|---|
| 4,518,001 A | | 5/1985 | Branham | |
| 4,881,919 A | | 11/1989 | Dabrowski | |
| 5,061,222 A | * | 10/1991 | Suris | 453/57 |
| 5,167,571 A | * | 12/1992 | Waller | 453/29 |
| 5,285,883 A | * | 2/1994 | Le Hong et al. | 194/317 |
| 5,607,352 A | | 3/1997 | Tani | |
| 6,540,602 B2 | * | 4/2003 | Adams et al. | 453/40 |
| 6,848,988 B2 | * | 2/2005 | Kurosawa | 453/33 |

FOREIGN PATENT DOCUMENTS

| | | |
|---|---|---|
| EP | 0044640 A2 | 1/1982 |
| EP | 0831430 A2 | 3/1998 |
| GB | 2185341 A | 7/1987 |
| GB | 2309811 A | 8/1997 |
| GB | 2352862 A | 2/2001 |
| GB | 2353129 A | 2/2001 |
| GB | 2378800 A | 2/2003 |
| GB | 2369229 A | 5/2003 |
| JP | 9319908 | 12/1997 |

* cited by examiner

*Primary Examiner*—Patrick Mackey
*Assistant Examiner*—Mark Beauchaine
(74) *Attorney, Agent, or Firm*—Chadbourne & Parke, LLP

(57) ABSTRACT

A coin dispensing apparatus dispenses coins by squeezing them substantially chordally between first and second elements. The second element is carried on the underside of a disc-like portion of a rotor which rotates about or with a central shaft. The disc-like portion has an opening, allowing coins to move axially therethrough from a supply side to a position aligned with the second element. The opening has a diameter substantially equal to or greater than the radius of the rotor.

8 Claims, 6 Drawing Sheets

COIN HOPPER WITH LARGE COIN CAPABILITY

BACKGROUND OF THE INVENTION

The present invention relates to a coin, or the like, dispensing apparatus.

In the following, the term "coin" will be used to mean coins, tokens or the like.

The Compact Hopper™ made by Money Controls Limited of New Coin Street, Royton, Oldham, UK is well-known to those skilled in the art. The Compact Hopper™ dispenses coins using a rotor and a pair of sprung fingers. The rotor has a plurality of apertures in which coins collect and as the rotor rotates, coins are dispensed from the bottoms of the apertures by the action of the sprung fingers. Rotors with different sized apertures are used for dispensing different sized coins.

In the Compact Hopper™, the rotor rotates on a central shaft. Consequently, coins having diameters greater than the radius of the rotor could not be dispensed.

United Kingdom patent application no. 2,369,229 discloses a coin dispensing apparatus which can dispense coin having diameters greater than the radius of the rotor. This is achieved by connecting the rotor to a foot by a offset connecting element like a crank and connecting the foot to a drive shaft. A problem with this apparatus is that it requires major modification of the rotor bed, making it unsuitable for retrofitting.

BRIEF SUMMARY OF THE INVENTION

According to a first aspect of the the present invention, there is provided a coin dispensing apparatus which dispenses coins by squeezing them substantially chordally between first and second elements, comprising a rotor which rotates with or about central shaft means and comprises:

a disc-like portion carrying said second element on its underside and an opening, allowing coins to move axially therethrough from a supply side to a position aligned with said second element, the opening having a diameter substantially equal to or greater than the radius of the rotor, and a locating portion received in a recess, wherein the recess is provided by the hole in the middle of a discrete annular member.

The first element may be a projection from the top of the annular member. The annular member may also be resiliently mounted for restricted circumferential movement.

The opening may break the circumference of the disc-like portion.

The locating portion may extend partially across said opening such that locating portion is spaced axially from the underside of the disc-like portion.

According to a second aspect of the present invention, there is provided a coin dispensing apparatus including:

a surface;

an annular member on said surface and having a hole;

a coin exit;

a first ejector element;

a shaft means;

a rotor which rotates with or about the shaft means and comprises:

a disc-like portion carrying a second ejector element on its underside and an opening, allowing coins to move axially therethrough from a supply side to a position aligned with said second ejector element, the opening having a diameter substantially equal to or greater than the radius of the rotor, and a locating portion received in said hole in the annular member;

wherein the first and second ejector elements being arranged to squeeze a coin along a chord thereof so as to eject it through the coin exit during rotation of the rotor.

The first ejector element may be a projection from the top of the annular member.

The annular member may also be resiliently mounted for restricted circumferential movement.

The opening may break the circumference of the disc-like portion.

The locating portion may extend partially across said opening such that locating portion is spaced axially from the underside of the disc-like portion.

According to a third aspect of the present invention, there is provided a large coin adaptation kit for adapting a coin dispensing apparatus which dispenses relatively small coins by squeezing them substantially chordally between first and second elements, the second element being carried on the underside of a disc-like portion of a rotor which rotates with or about central shaft means, wherein the rotor is mounted in a hollow and the disc-like portion has an opening, allowing said relatively small coins to move axially therethrough from a supply side to a position aligned with the second element, the kit including:

a spacer for placement in said hollow to create a recess through which the rotor's axis of rotation extends; and a replacement rotor having a locating portion configured to be received in said recess and an opening, allowing relatively large coins to move axially therethrough, having a diameter substantially equal to or greater than the radius of the replacement rotor.

The opening may break the circumference of the disc-like portion.

The spacer may have a projection to provide a replacement first element for large coins. The spacer may also include means for coupling it to the small coin first element of the apparatus being adapted. Adaption in this way is desirable because the optimum position for the small coin first element is often not suitable for larger coins. The use of the spacer means that the first element position can be optimised for both small and large coins.

The locating portion may extend partially across said opening such that locating portion is spaced axially from the underside of the disc-like portion.

The kit may include means for providing a wider coin exit path, in which a coin being dispensed moves edgeways, to said apparatus.

The kit may include means for providing a wider coin exit path, in which a coin being dispensed moves edgeways, to said apparatus.

DETAILED DESCRIPTION OF THE INVENTION

Embodiments of the present invention will now be described, by way of example, with reference to the accompanying drawings.

Figure 1:
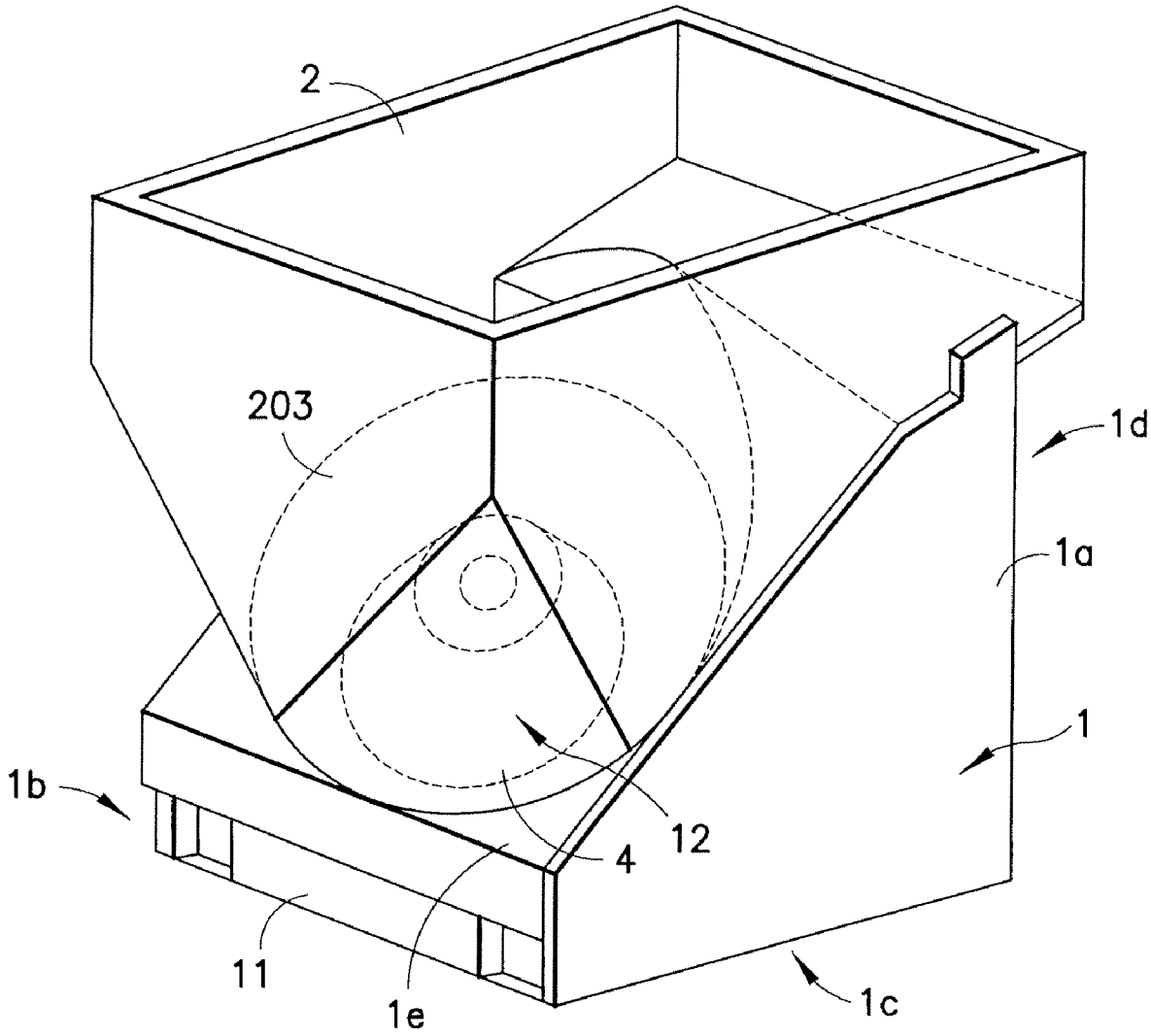
FIG. 1 is a perspective view of a coin dispensing apparatus.

Referring to FIG. 1, a coin dispensing apparatus, according to the present invention, comprises a body 1 and a transparent hopper 2 releasably clipped to the body 1.

The body 1 has a generally triangular cross-section with two generally triangular side faces 1*a*, 1*b* and rectangular bottom and back faces 1*c*, 1*d*. The side, bottom and back faces 1*a*, 1*b*, 1*c*, 1*d* need not be solid.

The front face 1*e* of the body slopes save for a short vertical portion 1*f* at the very front. An interchangeable rotor 203 is rotatably located in a rotor seat 4 in the sloping front face 1*e* of the body 1. The rotor 203 is for use with coins of large diameter and can be interchanged with a rotor 103 (FIG. 4) for smaller diameter coins, as will be explained in more detail hereinafter. A motor and transmission (not shown) are mounted behind the rotor seat 4. The rotor seat 4 may be removable as a unit with the motor and transmission. The rotor seat 4 in this example is approximately 85 mm square. However, the generally preferred range is 50-120 mm square.

The hopper 2 is conventional and is open at the top with sides that extend upwards from the tops of the sides of the body 1. The underside of the hopper 1 conforms generally to the front face 1*e* of the body 1 and has hole opening onto the rotor seat 4. A hopper having a wider upper part may be used to increase the capacity of the apparatus.

Figure 2:
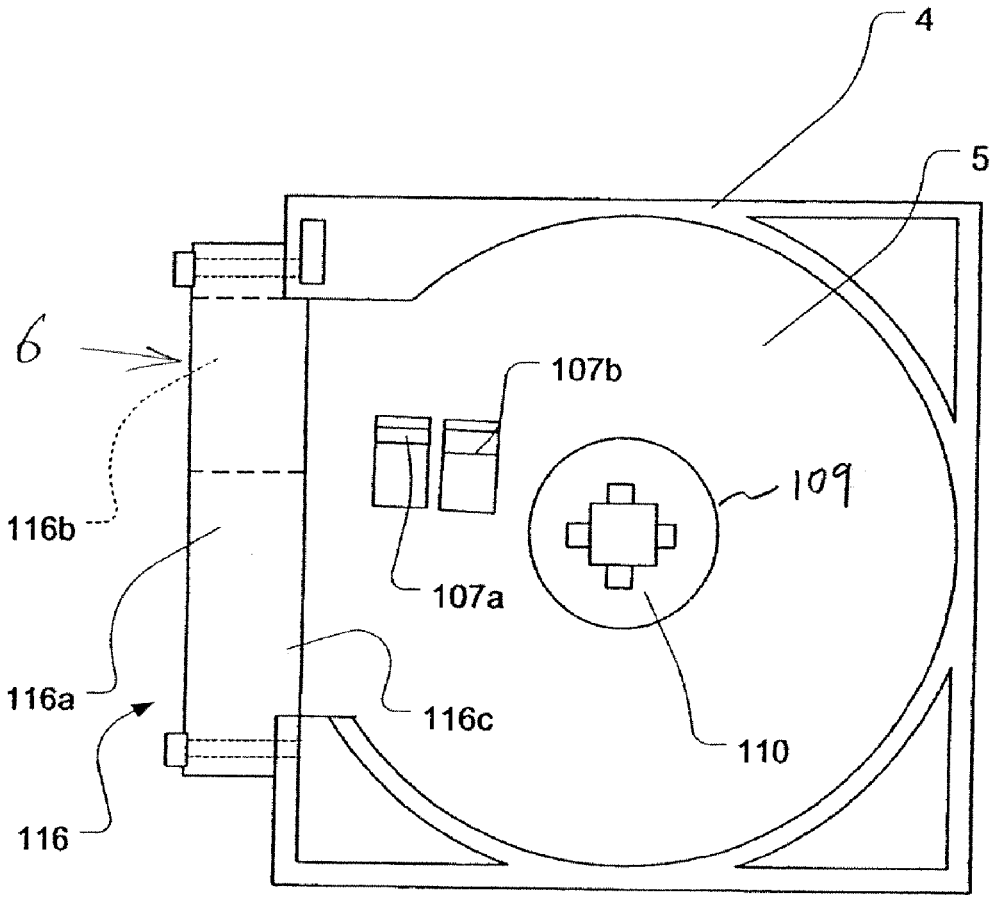
FIG. 2 is a front view of the rotor seat of an apparatus according to the present invention.

Referring to FIG. 2, the rotor seat 4 is square, when viewed along the rotor axis. A generally circular hollow 5 is formed in the rotor seat 4. The hollow 5 has an opening 6 along one side through which coins are ejected. A coin output guide 116 is mounted across the opening 6.

Figure 3:
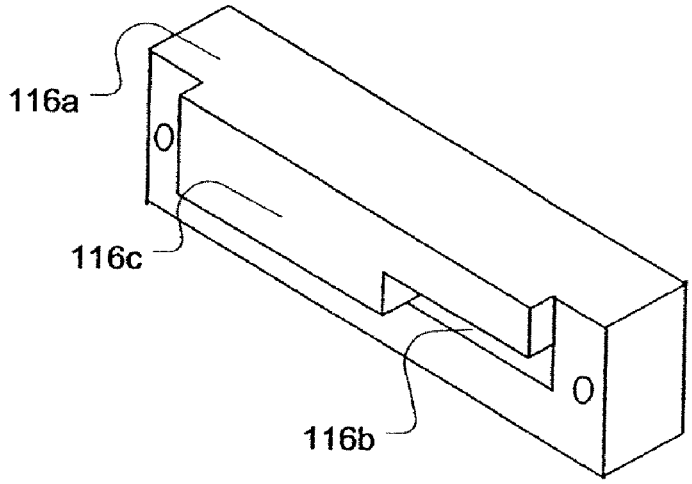
FIG. 3 is a perspective view of a small coin exit-defining block.

Referring additionally to FIG. 3, a coin output guide 116 for small coins comprises a generally rectangular block 116*a* which is screwed to the rotor seat 4. A rectangular-section coin passage 116*b* extends through the block 116*b*. When the block 116*a* is mounted to the rotor seat 4, one side of the passage 116*b* is aligned with the top edge of the opening 6. The block 116*a* has an L-section projection 116*c* when projected into the rotor seat 4 to block the opening 6 except for a short extension of the passage 116*b*. The extension of the passage 116*b* is defined in part by the floor of the hollow 5.

A pair of sprung fingers 107*a*, 107*b*, project through the floor of the hollow 5 radially in from the lower edge of the passage 116*b*.

A boss 109, on the end of a rotor-driving shaft (not shown) projects through the floor of the hollow 5 in the rotor seat 4. A male coupling part 110 is formed on the boss 109 for connecting to rotors.

Figure 4:
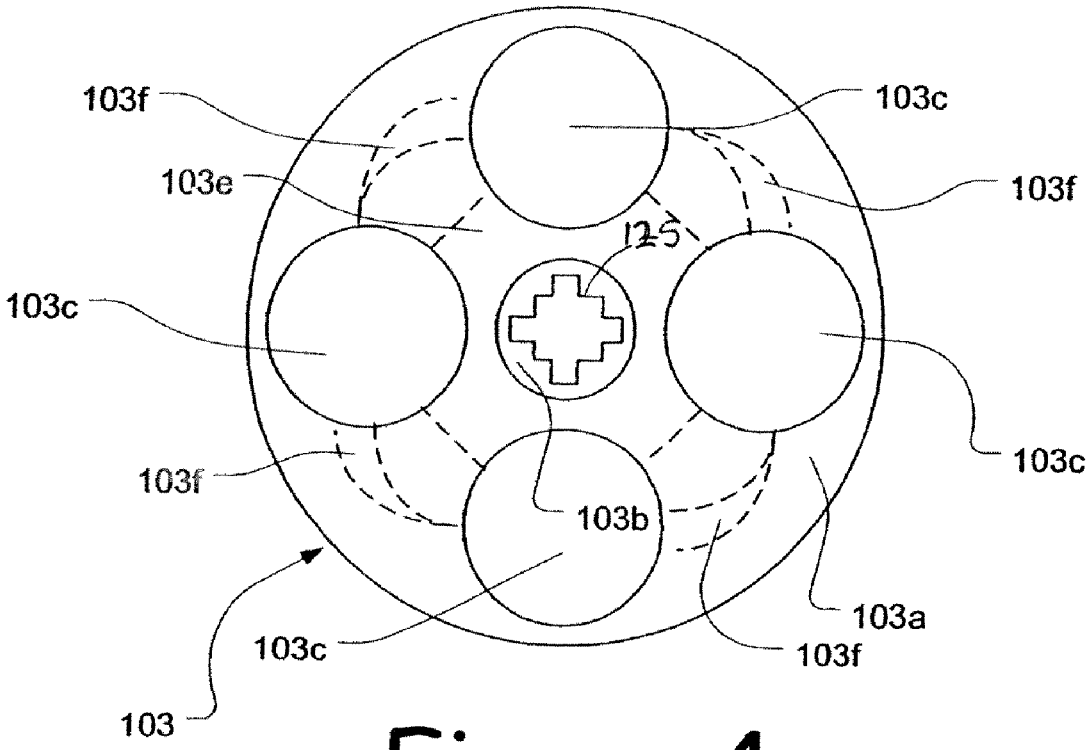
FIG. 4 is a top view of a conventional small coin rotor.

Referring to FIG. 4, a rotor 103 for small coins comprises a disc 103*a* with a central recess 103*b* and four through holes 103*c* arrayed equidistantly around the central recess 103*b*. A female coupling part 125 is formed in the bottom of the recess 103*b* and is configured to receive the male coupling part 110 releasably so that the rotor 103 can be driven by the rotor driving shaft.

The underside of the rotor 103 is cut away except for a central portion 103*e* and four projections 103*f* between respective pairs of through holes 103*c*.

The projections 103*f* and the sprung fingers 107*a*, 107*b* co-operate to eject coins fed through the through holes 103*c* in the conventional manner when the rotor 103 is being rotated.

The coins are ejected through the passage 116*b* in the block 116.

Figure 5:
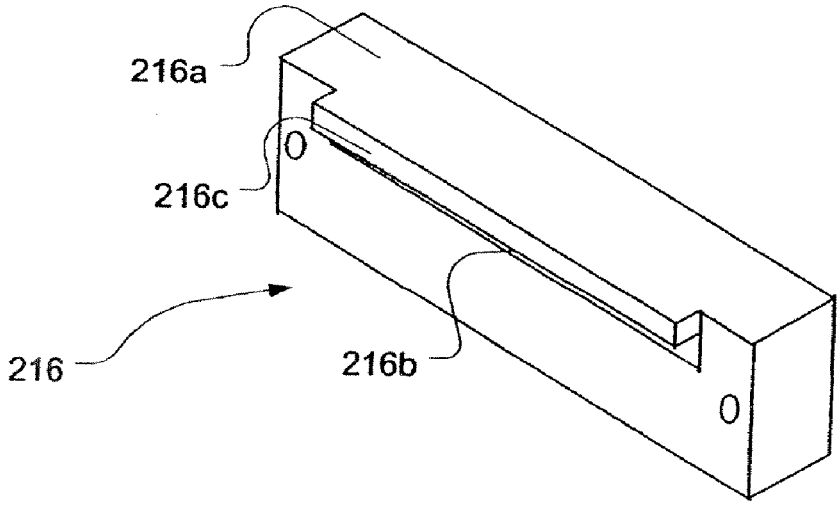
FIG. 5 is a perspective view of a large coin exit-defining block.
Figure 6:
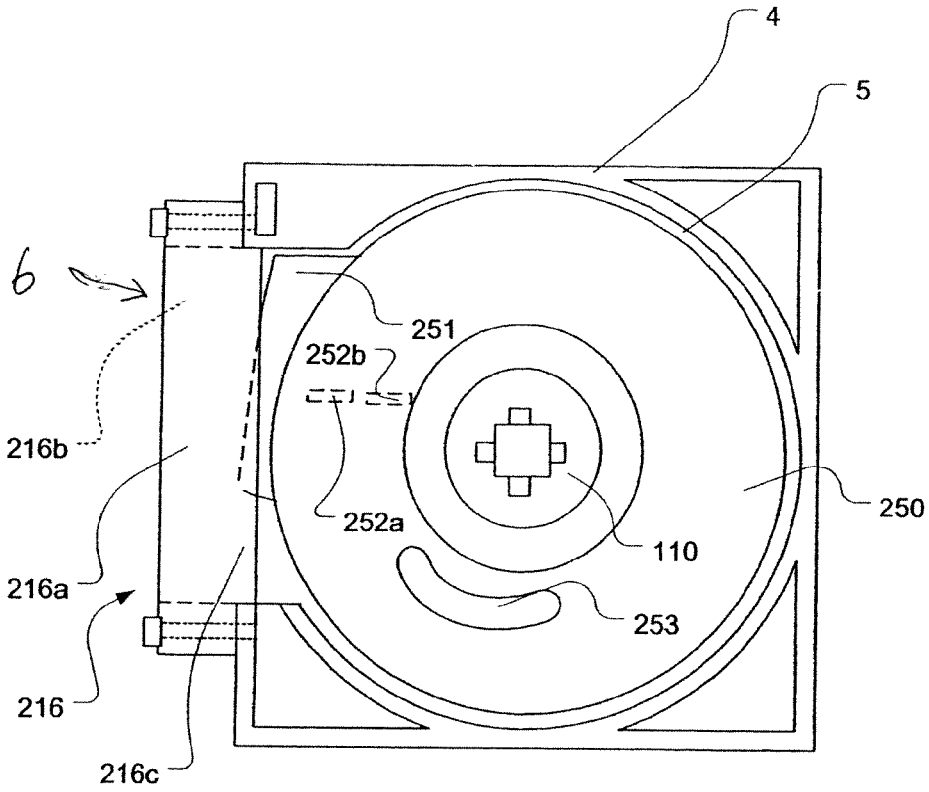
FIG. 6 is a front view of the rotor seat of FIG. 2 with an annular spacer in place.
Figure 7:
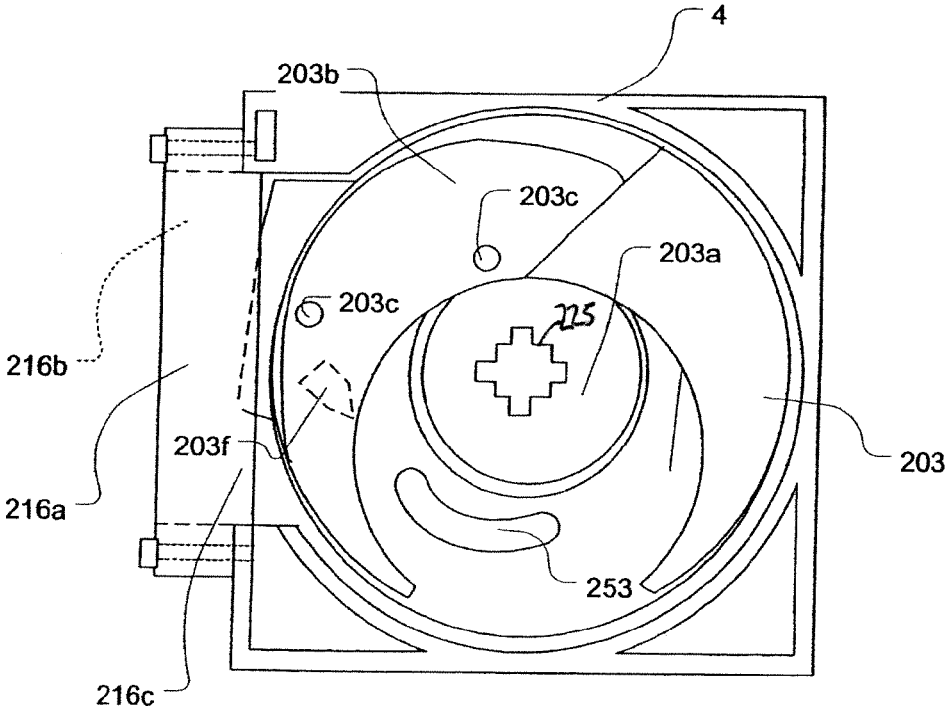
FIG. 7 is a front view of the rotor seat of FIG. 2 with the annular spacer and a large coin rotor in place.

The coin dispensing apparatus can be converted to dispense large coins by replacing the rotor 103 and the coin output guide 116, with a rotor 203 shown in FIG. 7 and output guide 216 shown in FIG. 5, and adding an annular spacer 250 shown in FIG. 6 on the rotor seat 5 under the rotor 203.

Referring to FIG. 5 the coin output guide 216 for large coins comprises a block 216*a* with a slot 216*b* corresponding to the width of the opening 6. A ridge 216*c* projects from above the slot 216*b* and defines the roof of an extension of the slot 216*b* into the rotor seat 4. The slot 216*b* is somewhat higher in the block 216 than the passage 116*b* in the small coin block 116.

Since the sprung fingers 107*a*, 107*b* are not in the correct position for large coins, a device is provided to produce a corresponding effect at the appropriate position.

Referring to FIG. 6, an annular spacer 250 is positioned in the hollow 5 around the boss 110. A pair of tabs 252*a*, 252*b* project from the underside of the spacer 250 and engage respective ones of the sprung fingers 107*a*, 107*b*. A curved ridge 253 projects from the top of the spacer 250. The ridge 253 starts at a point radially inwards from the lower edge of the opening 6. The nose of the ridge 253 which comes into contact with coins is rounded.

A chamfered tab 251 projects from the circumference of the spacer 250 towards the opening 6 to guide coins being ejected. The floor of the slot 216*b* is aligned with the top of the radially outer side of the chamfered tab 251.

Referring to FIG. 7, a large coin rotor 203 comprises a cylindrical locating portion 203*a*, a crescent portion 203*b* and a connecting portion (not shown) connecting the locating portion 103*a* to the crescent portion 203*b*. The locating portion 203*a* has the same thickness as the spacer 250, around the spacer's central hole, and a female coupling part 225 for connecting to the male coupling part 110 on the boss 109.

The crescent portion 203*b* has the form of a dished disc with an eccentric circular cut-out. The dished upper face of the crescent portion 203*b* is sculpted and provided with projections 203*c* to agitate coins in the hopper 2 and guide coin correctly into the cut-out as the rotor 203 rotates. The connecting portion is located at the edge of the cut-out.

Since the operation of the coin dispensing apparatus requires coins to pass partially under the rotor 203, the connecting portion raises the crescent portion 203*b* above the spacer 250.

The dispensing of a large coin by the apparatus shown in FIGS. 7 to 11 will now be described.

Figure 8:
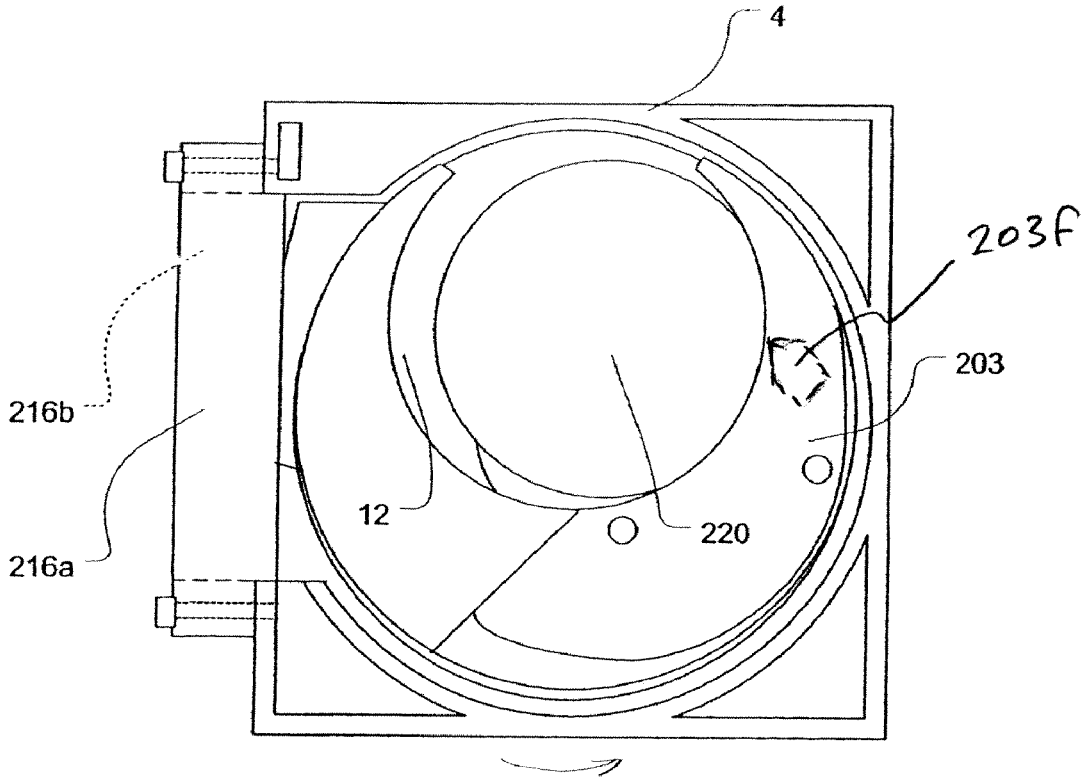
FIGS. 8 to 11 show the large coin rotor, shown in FIG. 7, at first to fourth positions during ejection of a large coin.

Referring to FIG. 8, the rotor 203 is positioned so that the gap in the rotor 203 is at about 12 o'clock. The rotor 203 is being rotated anti-clockwise and a coin 220 is received in the cut-out 12.

Figure 9:
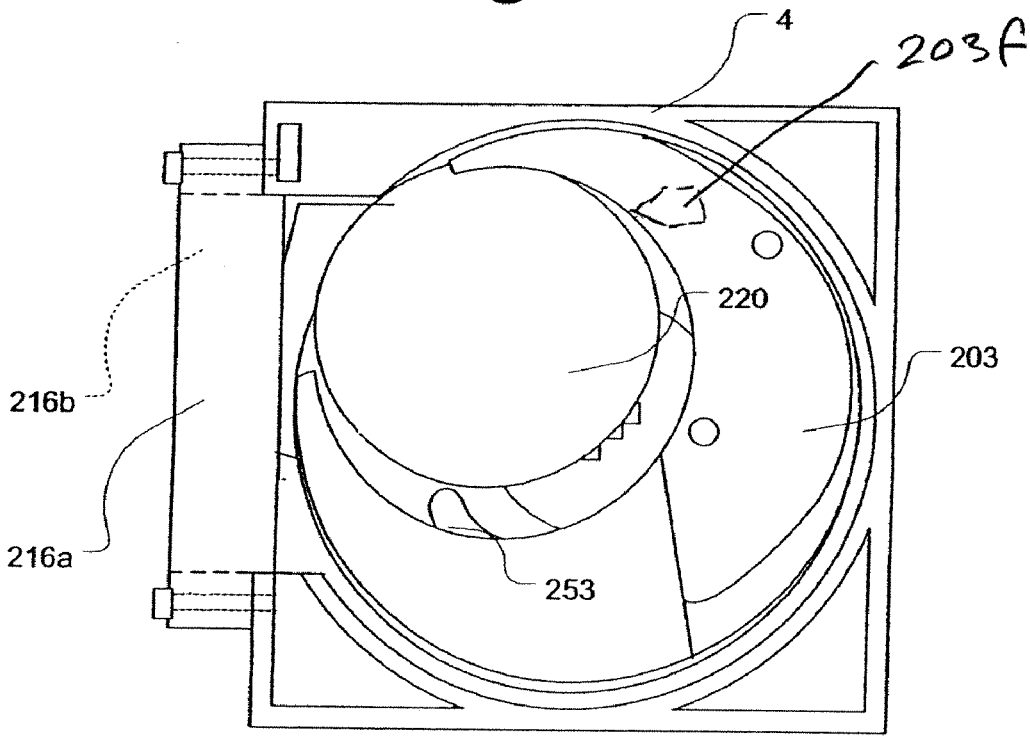

Referring to FIG. 9, as the rotor 203 rotates, the coin 220 is propelled by a projection 203*f* on the underside of the crescent portion 203*b* and begins to engage the nose of the ridge 253.

Figure 10:
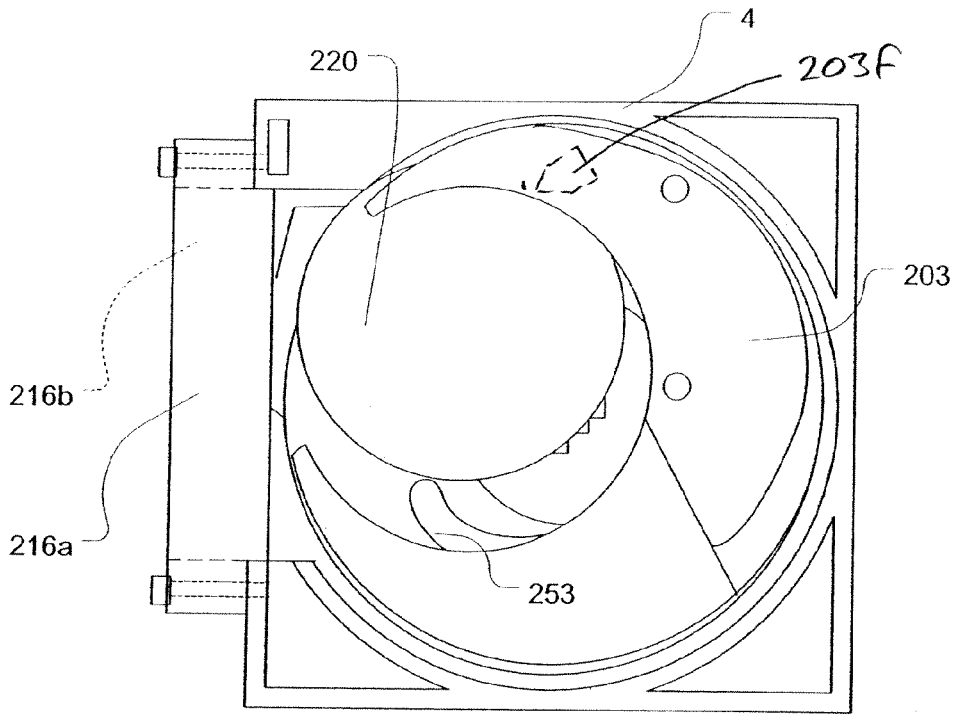

Referring to FIG. 10, as the rotor 203 rotates further, the coin 220 presses against the nose of the ridge 253, causing the spacer 250 to rotate and displace the sprung fingers 107*a*, 107*b*. This causes the coin 220 to be pressed against the wall of the hollow 5.

Figure 11:
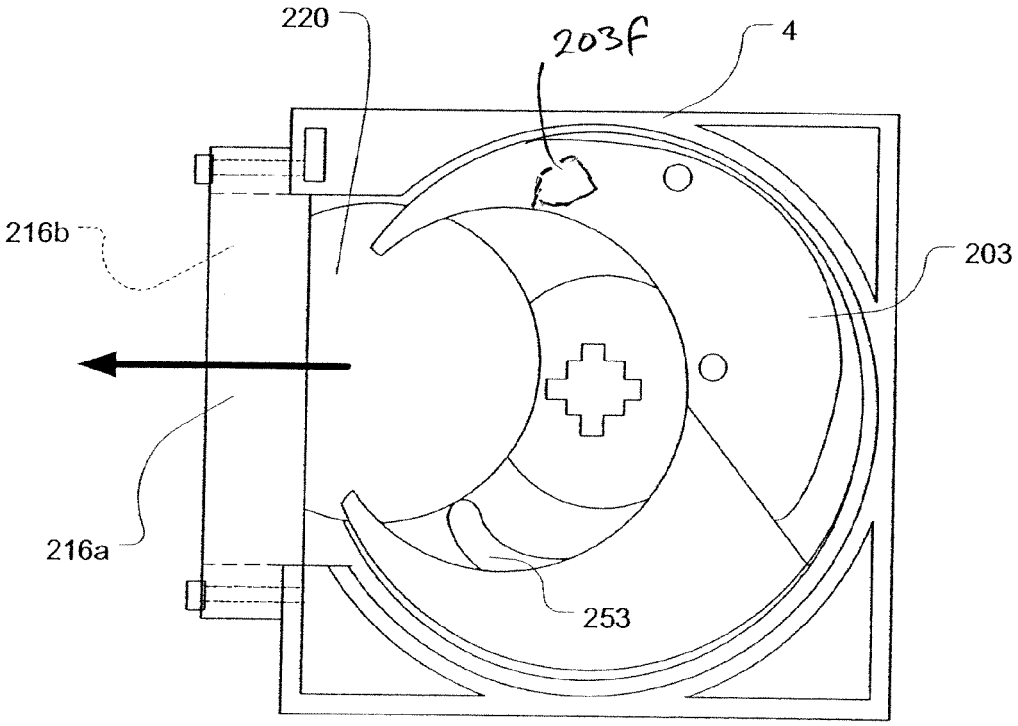

Referring to FIG. 11, a small further movement of the rotor 203 aligns the coin 220 fully with the opening with the result that the ridge 253, urged by the sprung fingers 107*a*, 107*b*, and the projection on the underside of the rotor 203, acting chordally across the coin 20, eject the coin through the opening 6.

Optical and/or electromagnetic sensor may be included in the coin output guides to detect coins being ejected.

A coin dispensing apparatus may be supplied as a common body and hopper and an appropriate adaptation kit. In this embodiment, an adaptation kit comprises a rotor and a coin output guide and optionally a spacer where the kit is a large coin kit.

It will be appreciated that many modifications may be made to the embodiments described above. For example, different arrangements for centrally driving the rotors may be used.

The invention claimed is:

1. A coin dispensing apparatus which dispenses coins by squeezing them substantially chordally between first and second elements, comprising a rotor which rotates with or about central shall means and comprises:

substantially disc-shaped portion carrying said second element on its underside and an opening, allowing coins to move axially therethrough from a supply side to a position aligned with said second element, the opening having a diameter substantially equal to or greater than the radius of the rotor, and a locating portion received in a recess;

a discrete annular member, and a coupling on the underside of said annular member restricting circumferential movement of said annular member, wherein the recess is provided by a hole in the middle of the discrete annular member; and the first element is a projection from the top of the annular member.

2. An apparatus according to claim 1, wherein the opening breaks the circumference of the substantially disc-shaped portion.

3. An apparatus according to claim 1, wherein the first element is a projection from the top of the annular member, the annular member is resiliently mounted for restricted circumferential movement and the locating portion extends partially across said opening such that locating portion is spaced axially from the underside of the substantially disc-shaped portion.

4. An apparatus according to claim 3, wherein the opening breaks the circumference of the substantially disc-shaped portion.

5. A coin dispensing apparatus including:

a surface;

an annular member on said surface and having a hole; a coupling on the underside of said annular member restricting circumferential movement of said annular member;

a coin exit;

a first ejector element comprising a projection from the top of the annular member;

a shaft means;

a rotor which rotates with or about the shaft means and comprises:

a substantially disc-shaped portion carrying a second ejector element on its underside and an opening, allowing coins to move axially therethrough from a supply side to a position aligned with said second ejector element, the opening having a diameter substantially equal to or greater than the radius of the rotor, and a locating portion, connected directly or indirectly to the substantially disc-shaped portion, received in said hole in the annular member;

wherein the first and second ejector elements being arranged to squeeze a coin along a chord thereof so as to eject it through the coin exit during rotation of the rotor.

6. An apparatus according to claim 5, wherein the opening breaks the circumference of the substantially disc-shaped portion.

7. An apparatus according to claim 5, wherein the first ejector element is a projection from the top of the annular member, the annular member is resiliently mounted for restricted circumferential movement and the locating portion extends partially across said opening such that locating portion is spaced axially from the underside of the substantially disc-shaped portion.

8. An apparatus according to claim 7, wherein the opening breaks the circumference of the substantially disc-shaped portion.

* * * * *

UNITED STATES PATENT AND TRADEMARK OFFICE

CERTIFICATE OF CORRECTION

PATENT NO. : 7,294,051 B2
APPLICATION NO. : 11/157676
DATED : November 13, 2007
INVENTOR(S) : Malcolm Reginald Hallas Bell It is certified that error appears in the above-identified patent and that said Letters Patent is hereby corrected as shown below:

Column 5, line 31, “shall” should be changed to --shaft--.

Signed and Sealed this

Twentieth Day of May, 2008

JON W. DUDAS
*Director of the United States Patent and Trademark Office*